United States Patent [19]

Comeau et al.

[11] Patent Number: 4,566,851

[45] Date of Patent: Jan. 28, 1986

[54] FIRST STAGE TURBINE VANE SUPPORT STRUCTURE

[75] Inventors: Roger J. Comeau, Ware, Mass.; Walter J. Baran, Jr., So. Glastonbury, Conn.

[73] Assignee: United Technologies Corporation, Hartford, Conn.

[21] Appl. No.: 609,911

[22] Filed: May 11, 1984

[51] Int. Cl.[4] ..... F01D 25/24

[52] U.S. Cl. ..... 415/139; 415/138; 415/217; 415/218

[58] Field of Search ..... 415/139, 138, 137, 189, 415/136, 217, 218, 216

[56] References Cited

U.S. PATENT DOCUMENTS

| | | | |
|---|---|---|---|
| 2,488,867 | 11/1949 | Judson | 415/172 A |
| 2,932,485 | 4/1960 | Small, Jr. et al. | 415/137 |
| 2,942,844 | 6/1960 | Neate | 415/137 |
| 3,043,564 | 7/1962 | Small, Jr. | 415/137 |
| 3,062,499 | 11/1962 | Peterson | 415/137 |
| 3,066,911 | 12/1962 | Anderson et al. | 415/138 |
| 3,295,751 | 1/1967 | Sceggel | 415/218 |
| 3,295,824 | 1/1967 | Woodwell et al. | 415/218 |
| 3,363,416 | 1/1968 | Heybyrne et al. | 415/216 |
| 3,443,791 | 5/1969 | Sevetz et al. | 415/218 |
| 3,730,640 | 5/1973 | Rice et al. | 415/217 |
| 3,765,791 | 10/1973 | Trappmann | 415/138 |
| 3,824,034 | 7/1974 | Leicht | 415/217 |
| 3,957,391 | 5/1976 | Vollinger | 415/217 |
| 3,965,066 | 6/1976 | Sterman et al. | 415/138 |
| 4,274,805 | 6/1981 | Holmes | 415/138 |
| 4,391,565 | 7/1983 | Speak | 415/189 |

FOREIGN PATENT DOCUMENTS

| | | | |
|---|---|---|---|
| 2517044 | 11/1975 | Fed. Rep. of Germany | 415/136 |

*Primary Examiner*—Edward K. Look
*Assistant Examiner*—John Kwon
*Attorney, Agent, or Firm*—Charles A. Warren

[57] ABSTRACT

The first stage turbine vanes in a gas turbine are supported both axially and for torque control in a ring located within the diffuser case such that it is free to expand to minimize thermal stresses. The support ring is modified to permit assembly of all the turbines within the ring.

7 Claims, 2 Drawing Figures

FIRST STAGE TURBINE VANE SUPPORT STRUCTURE

DESCRIPTION

1. Technical Field

Support structure for the first stage turbine vanes of a gas turbine engine in which the vanes are supported axially and for torque control by a ring positioned within the diffuser case.

2. Background Art

In the assembly of turbine vanes into the turbine structure it becomes increasingly important to relieve the case of thermal stresses resulting from expansion of the vanes during operation. It is also desirable to shield the case from the hot turbine vanes to reduce the operating temperature of the case. The patent to Small U.S. Pat. No. 3,043,564 attempts to reduce the thermal stresses in the case and provides the vanes without shrouds positioned in shroud rings which in turn are radially expandable in the case. This patent does not comtemplate a structure utilizing shrouded vanes. A later patent, Holmes U.S. Pat. No. 4,274,805, supports the vanes from the case in such a manner as to prevent transmission of thermal stresses from the vanes to the outer case. The outer vane shrouds are exposed directly to the surrounding case, however, and radiation of heat from the vane shrouds will increase the operating temperature of the case. Furthermore, the outer case is not shielded from hot gas leaking past the turbine shrouds.

DISCLOSURE OF INVENTION

A feature of the present invention is a support ring located between the vanes and the surrounding case and forming a heat shield therebetween. Another feature is the mounting of the ring so as to transmit minimal thermal loads to the surrounding case with the ring contacting the case in an area of thermal compatibility. The ring also serves to support the vanes axially at the outer end of each vane. Another feature is the provision of anti-torque means between the individual vanes and the supporting ring to pick up the torque load on the individual vanes. The support ring further provides a cooling air passage and seals the cooling air from the power gas. A particular feature is the arrangement of the anti-torque structure to permit assembly of the vane with individual torque devices into the support ring.

According to the invention a sleeve is supported within and generally spaced from the diffuser case and the sleeve supports the turbine vanes by flanges or lugs on the outer vane shroud that are received between flanges on the inner surface of the sleeve. Torque from the vanes is absorbed through pins on the vane flanges engaging one of the sleeve flanges and this torque in the ring is transmitted to the case through torque lugs on the sleeve. One of the flanges on the sleeve has an extended rearward lateral flange at its inner end to support an intermodular seal. The sleeve is wide enough to form a heat shield for the surrounding case and serves to direct cooling fluid across its inner surface for reducing heat transfer to the case.

Other features and advantages will be apparent from the specification and claims and from the accompanying drawings which illustrate an embodiment of the invention.

BEST MODE FOR CARRYING OUT THE INVENTION

Figure 1:
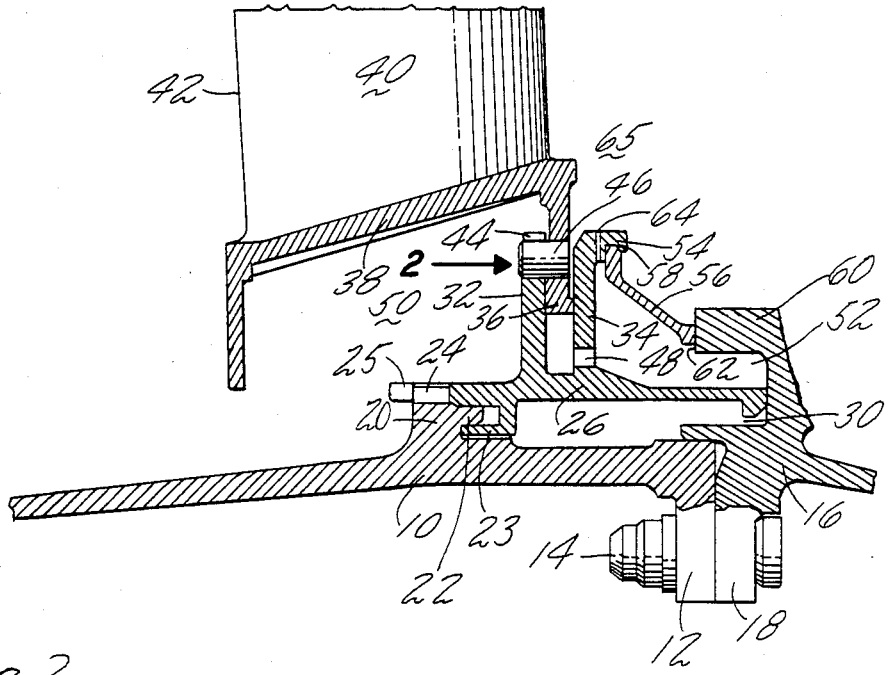
FIG. 1 is a fragmentary longitudinal sectional view showing the vane support structure.
Figure 2:
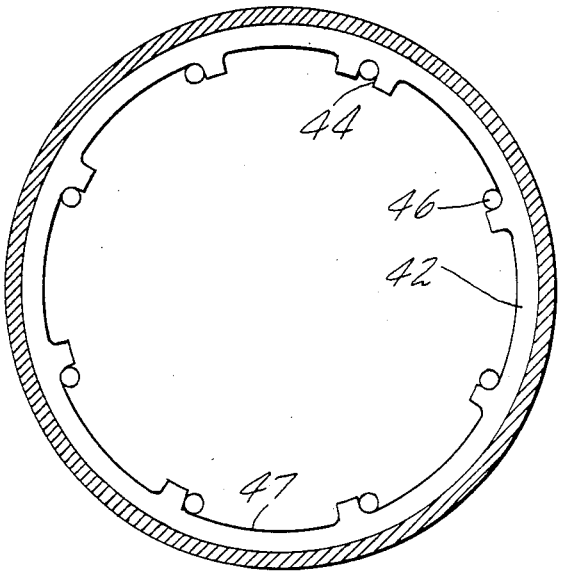
FIG. 2 is a view in the direction of the arrow 2 of FIG. 1 showing the location of the torque slots.

The invention is shown in a gas turbine construction which includes a diffuser case 10 having an outwardly extending mounting flange 12 by which this case is bolted as by bolts 14 to the turbine case 16 the latter having a mating flange 18. The diffuser case has an inward extending spacer flange 10 and serves to pilot the sleeve at this point, a rearwardly extending hook 22 as well as slots 24. A sleeve 26 contains both a hook 23 as well as lugs 25 which engage both the hook 22 and slot 24 of the diffuser case 20.

The joint between the diffuser case and the sleeve provides radial and circumferential support for the sleeve and spaces the sleeve radially relative to the diffuser case. This sleeve is generally cylindrical and extends rearward to the turbine case 16 which provides axial support. It will be understood that adequate clearance is provided between the case 16 and the diffuser case flange 20 to permit thermal expansion of the sleeve without imparting stress to the surrounding case. Radial clearance 30 has been provided between the sleeve 26 and the turbine case 16 at the rear of the sleeve where it contacts the turbine case.

The inner surface of the sleeve has spaced flanges 32 and 34 to receive between them the outwardly extending mounting flanges or lugs 36 on the outer shrouds 38 of the turbine vane 40, the latter having an operative air flow portion 42 over which the power gas passes. The upstream flange 32 has a narrow notch 44 and elongated notches 47 therein extending radially outward from the inner periphery of the flange and these notches receive and engage torque pins 46 positioned in the lugs 36 on the vane shrouds. These pins extend axially and are secured in the lugs 36 to extend forwardly therefrom for a secure engagement in the notches thereby to provide torque means for the vanes and to prevent circumferential movement of the vanes relative to the sleeve.

These flanges or lugs 36 fit between the two flanges 32 and 34 on the sleeve so as to prevent axial movement of the vanes relative to the sleeve thereby absorbing any axial thrust on the vane. The notches 47 and 44 are deep enough and the space between the flanges 32 and 34 is deep enough radially to permit thermal expansion of the vanes relative to the sleeve during turbine operation. With the sleeve constructed as described, it is possible to assemble all the vanes by tipping the individual vane and sliding the lug thereon radially into the space between the flanges 32 and 34 and positioning the torque pin in the associated slot. The last vane can also be assembled in this manner since the notches 47 allow the remaining vanes to shift circumferentially and provide enough clearance between the outer shrouds of the vanes to permit its assembly. It will be understood that all of the vanes need not carry a torque pin. In the arrangement shown there are fewer pin slots than there are vanes so that, for example, only each second vane has a torque pin. Thus there is no need for a torque pin slot on the last vane to be positioned in the assembly, as the torque on this vane will be transmitted tangentially to the adjacent shroud and thence to the pin on that vane.

The flange 34 has a plurality of cooling holes 48 therethrough close to the sleeve to permit the flow of cooling air from the space 50 upstream of the flange 20 and within the sleeve 26 over the inner surface of the sleeve, through the bases of the notches 44 and the spaces between the flanges 36 on the vanes into the space 52 between the flanges 32 and 34 and thence through the holes 48 into the space 52 within the sleeve 26 downstream of the flange 34. It will be understood that the cooling air leaking past the lugs and into the space between the flanges into space 52 is essentially leakage air. It is desired to limit the amount of this cooling air passing through the turbine at this point to as great an extent as possible.

The inner surface of flange 34 contains an array of radially oriented holes 64. These holes provide for spray cooling air inwardly into the cavity 65 directly above the flange. This air is used to flow outward into the power gas flow stream thereby discouraging the outward flow of the hot power gas onto the flange itself and adjacent members.

At the inner end of the flange 34 is a lateral flange 54 that supports at its outer surface an inner modular seal in the form of a conical ring 56. The inner edge of this ring seal is held in a groove 58 in the flange 54 to prevent axial movement and the outer edge of the ring seal engages laterally with a fixed structural element 60 of the assembly. This element has a radial surface 62 against which the ring seal engages. This element 60 is in fixed relation to and generally a point of the turbine case 16 as will be understood.

The effect of the sleeve 26 mounted as it is in the assembly is to provide a support for the row of turbine vanes and torque absorbing structure for the vanes at the outer ends and to provide a heat shield for the surrounding diffuser case. The arrangement also provides an outer air seal cooling air passage and seals the cooling air from the gas path. The seal is so mounted as to permit radial and axial movement within the support structure to relieve stresses between the sleeve and its supporting structure. The forward portion of the sleeve serves as a heat shield and protects the surrounding case and flange mounting from compressor air and thermal loads. The lateral flange further provides a seal from gas path air and supports the inner modular seal at this point. The arrangement of the notches in the flange 32 permit assembly of the vanes with the anti-torque pins thereon into the sleeve since the elongated notches permit circumferential movement until the pin engages one end of the notch 47.

Although the invention has been shown and described with respect to a preferred embodiment thereof, it should be understood by those skilled in the art that other various changes and omissions in the form and detail thereof may be made therein without departing from the spirit and the scope of the invention.

We claim:

1. A vane assembly for a turbine including:

a surrounding case having a mounting flange on its outer surface and a spacer flange on its inner surface spaced forwardly, axially from, the mounting flange, a sleeve positioned within said case and supported radially and axially by said spacer flange adjacent its forward end, spaced flanges on the inner surface of the sleeve, one of said flanges having radial slots in its inner periphery, a turbine case secured to the mounting flange and engaging the rearward end of the sleeve to hold it in axial position only, and a row of turbine vanes positioned within the sleeve, each vane having an outer shroud and a lug extending outwardly from said shroud, said lug being positioned between said spaced flanges in the sleeve, some of said lugs having axially extending torque pins thereon to engage in said slots, said flanges on the sleeve are upstream from one another and in which the upstream flange has the slots therein and the flange downstream thereof has cooling air passages closely spaced from the sleeve, and in which some of the slots are elongated to permit circumferential movement of the vanes for assembly, and said flange downstream of the lugs has a lateral flange at its inner end and an inner modular seal supported by said lateral flange.

2. A vane assembly as in claim 1 including cooperating torque lugs and notches on said sleeve and case to transmit torque from the sleeve to the case.

3. A vane assembly as in claim 1 in which a cooperating case attached to the diffuser case has a notch therein to receive the end of the sleeve and to limit axial movement of the sleeve in a downstream direction.

4. A vane assembly as in claim 3 in which the torque lugs and notches are on the spacer flanges and the forward end of the sleeve.

5. In a turbine assembly a diffuser case having a mounting flange at its downstream end and an inwardly extending flange extending inwardly from the case at a point spaced upstream from the mounting flange, a sleeve supported by said inwardly extending flange flange to hold the sleeve in spaced relation to the case except at the inwardly extending flange, a turbine case secured to the mounting flange and engaging the rearward end of the sleeve to hold it in axial position, spaced inwardly directed upstream and downstream flanges on said sleeve, the upstream flange having radial slots therein, some of the slots being elongated circumferentially, a row of turbine vanes each having an outer shroud and a lug extending outwardly therefrom, said lugs on the vanes being positioned between the flanges on the sleeve, and some of said lugs having torque pins thereon to engage said slots, and said sleeve and said case having cooperating torque lugs and notches to prevent turning of the sleeve within the case, said flanges on the sleeve are upstream from one another and in which the upstream flange has the slots therein and the flange downstream thereof has cooling air passages closely spaced from the sleeve, and in which some of the slots are elongated to permit circumferential movement of the vanes for assembly, and said flange downstream of the lugs has a lateral flange at its inner end and an inner modular seal supported by said lateral flange.

6. In a turbine assembly as in claim 5 in which there is a clearance between the sleeve and the surrounding case at the downstream end to provide for thermal expansion therebetween.

7. In a turbine assembly as in claim 5 the provision of the elongated notch larger circumferentially than the torque pin receiving notches and located in the same flange, this notch being wide enough circumferentially to accept the lug on one of the turbine vanes thereby to permit insertion of the last vane into position during assembly.

* * * * *

UNITED STATES PATENT AND TRADEMARK OFFICE

CERTIFICATE OF CORRECTION

PATENT NO. : 4,566,851

DATED : January 28, 1986

INVENTOR(S) : Roger J. Comeau & Walter J. Baran, Jr.

It is certified that error appears in the above-identified patent and that said Letters Patent is hereby corrected as shown below:

Column 2, line 15 "10 and serves to pilot the sleeve at this point" should be --20--.

Column 2, line 19 "20" should be --10 and serves to pilot the sleeve at this point--.

Signed and Sealed this

*Fifth* Day of *August 1986*

[SEAL]

*Attest:*

DONALD J. QUIGG

*Attesting Officer*

*Commissioner of Patents and Trademarks*